United States Patent [19]

Read

[11] 4,256,572

[45] Mar. 17, 1981

[54] PORTABLE SCREENING PLANT WITH OUTFEED CONVEYOR

[75] Inventor: James L. Read, Halifax, Mass.

[73] Assignee: F. T. Read & Sons, Inc., Rockland, Mass.

[21] Appl. No.: 102,613

[22] Filed: Dec. 11, 1979

Related U.S. Application Data

[63] Continuation-in-part of Ser. No. 947,380, Oct. 2, 1978, Pat. No. 4,197,194.

[51] Int. Cl.[3] ..... B07B 1/28

[52] U.S. Cl. ..... 209/257; 209/325; 209/420

[58] Field of Search ..... 209/240, 241, 243, 255, 209/257, 315, 325, 326, 329, 409, 420, 421, 412; 37/117.5, DIG. 3, DIG. 12

[56] References Cited

U.S. PATENT DOCUMENTS

| | | | |
|---|---|---|---|
| 1,806,934 | 5/1931 | Deister | 209/420 |
| 2,276,333 | 3/1942 | Oyestrud | 209/241 X |
| 2,284,692 | 6/1942 | Strube | 209/326 |
| 3,080,860 | 3/1963 | Riccio, Jr. | 209/257 X |
| 3,439,806 | 4/1969 | Kass et al. | 209/420 X |
| 3,701,422 | 10/1972 | Downey | 209/241 |

FOREIGN PATENT DOCUMENTS

| | | | |
|---|---|---|---|
| 1077822 | 11/1954 | France | 209/421 |

*Primary Examiner*—William A. Cuchlinski, Jr.
*Attorney, Agent, or Firm*—Hamilton, Brook, Smith & Reynolds

[57] ABSTRACT

A portable loam screening apparatus includes a nearly-square, sloping shaker screen supported by a box-like frame. The frame has a tall end and a short end joined by two sides. Funneling surfaces directed toward the screen are provided along the upper edges of the tall end and the sides. A mixture of coarse material and finer material is dumped onto the shaker screen from the shovel of an excavating vehicle. The coarse material falls from the lower end of the shaker screen outside of the frame, and the finer material passes through the shaker screen to within the box-like frame. The separated finer material is directed to an outfeed conveyer by a hopper or feed conveyor within the frame. The outfeed conveyor extends through one of the sides. A set of wheels mounted to one side of the frame is movable relative to the frame from an operative position for transporting the apparatus to an inoperative position for resting the frame flush on the ground. A trailer hitch is mounted to the other side of the frame and the shaker power source is mounted above the hitch.

9 Claims, 9 Drawing Figures

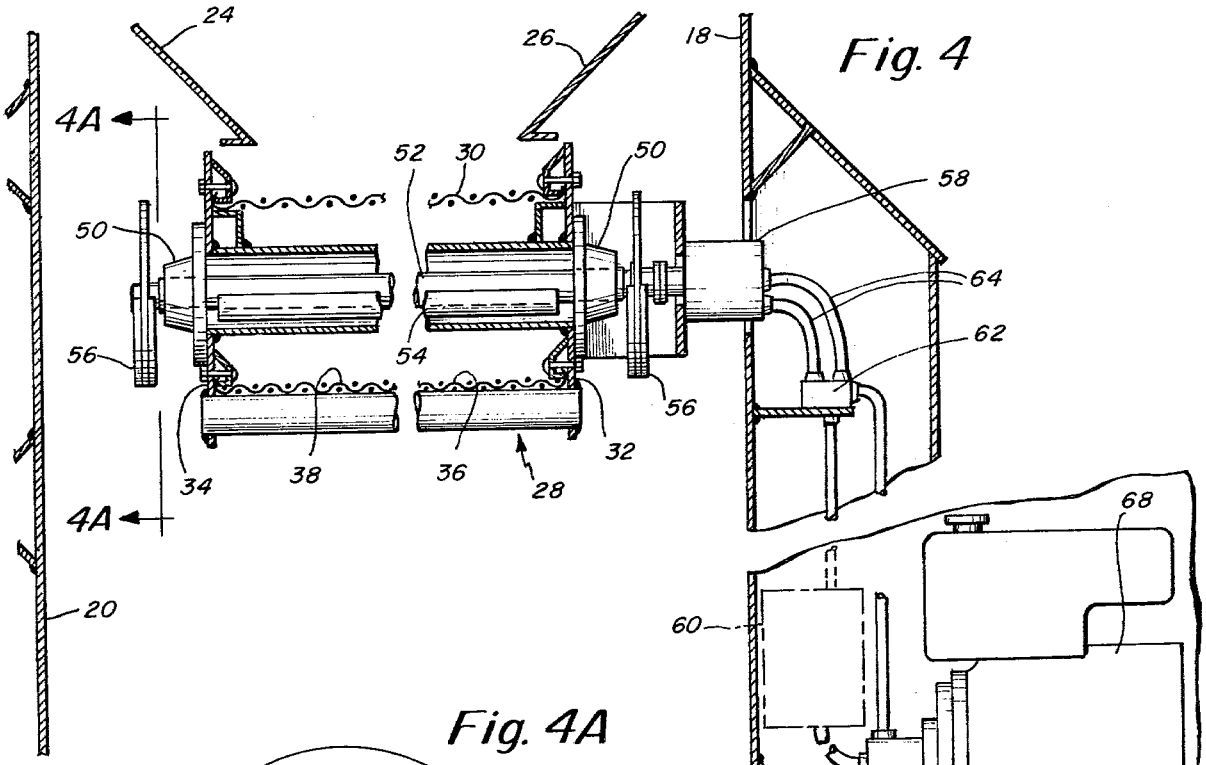
Fig. 4
Fig. 4A
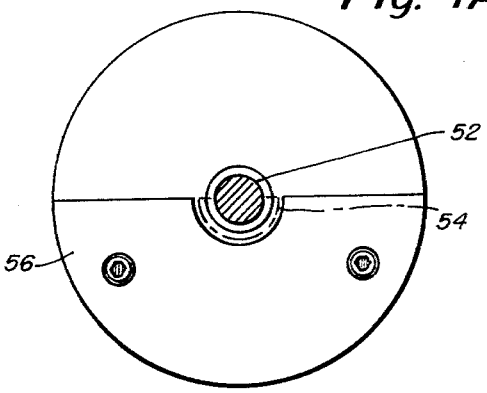
Fig. 5
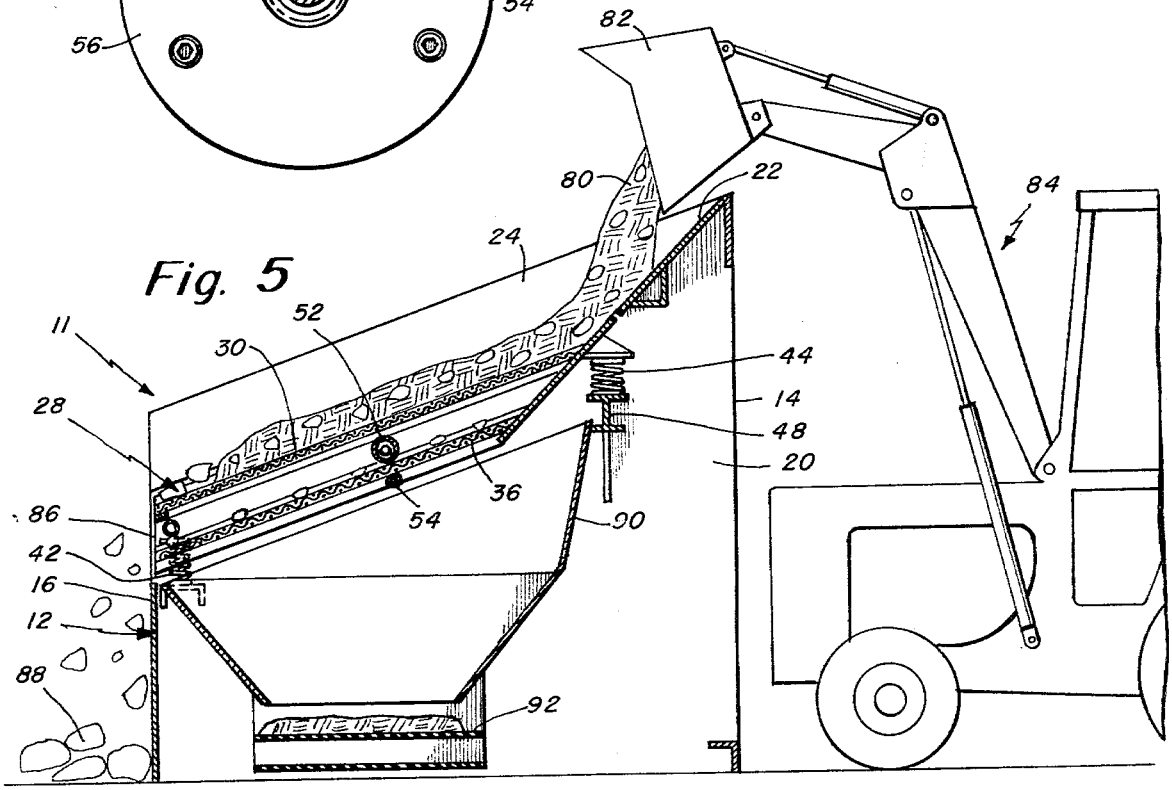

PORTABLE SCREENING PLANT WITH OUTFEED CONVEYOR

DESCRIPTION

1. Related Application

This is a continuation-in-part of U.S. application Ser. No. 947,380, filed Oct. 2, 1978, for a Loam Screening Plant.

2. Field of the Invention

This invention relates to screening apparatus for separating coarse material from finer material and more particularly to such an apparatus having a shaker screen.

BACKGROUND ART

In many separators known in the art, gravel or the like is laid across a vibrating shaker screen. The screen has a mesh size suitable for passing particles of a predetermined size therethrough while supporting and carrying larger particles to a chute, conveyor or the like. As a rule of thumb, it is generally stated that the downwardly sloping length of the shaker screen should be about two and a half times the width of the screen in order to maximize the separating rate and the quality of separation while keeping the separator to a reasonable size. Such separators generally require hoppers at the input end of the shaker screen to funnel the particles onto the screen.

Rich soil, or loam, is presently in high demand. Due to many regional restrictions on excavating, however, those who supply loam must often go to remote locations that offer rough top soil and separate the loam from coarse material such as gravel, decaying roots, stumps and so on. In order to avoid having to transport both the loam and the coarse material, it is highly desirable that a portable apparatus be used for separating the loam from the coarse material. To this end, many past shaker screen separators mounted on a truck or trailer have been reduced-scale imitations of stationary separator plants. Because of the extended lengths and reduced widths of these shaker screen separators, the separators require infeed hoppers or conveyors. These separators have not been reliable in separating loam from extremely bulky material, such as root stumps and the like, which have clogged the hoppers or conveyors.

An object of the present invention is to provide a shaker screen separator for separating loam or other fine material from exceptionally coarse material, that separator being portable for easy transport to the most remote regions.

A further object of this invention is to provide such a separator which is of exceptionally simple construction, not requiring the use of infeed hoppers, chutes or conveyors, but which provides an outfeed conveyor for the fine material.

Yet another object of this invention is to provide such a separator which is exceptionally durable even when used to separate the loam from heavy and bulky material such as tree stumps and large rocks.

SUMMARY

In accordance with the invention in one of its aspects, a portable screening apparatus comprises a frame of generally rectangular cross section and having a tall end and a short end joined by sides. The tall end is sufficiently wide and low to accomodate the shovel of a payloader. A loam separating shaker screen slopes downwardly from the tall end to an upper edge of the short end. A set of wheels, movable to an inoperative position, is mounted to one side and a hitch is mounted to the other side. An outfeed conveyor extends from within the frame through one of the sides.

In order to accommodate most payloaders, the tall end should be at least five feet wide and should be no more than ten feet tall. In order to meet most legal restrictions on width of a towed vehicle, the sides should be no longer than eight feet.

In accordance with one embodiment, finer material is directed to the outfeed conveyor by a hopper within the frame. And in accordance with another embodiment, the finer material is directed to the outfeed conveyor by a wide feed conveyor positioned below the shaker screen within the frame.

Other details of the screening apparatus include closed sides and a power source mounted to one side. Three funneling surfaces extend inwardly and downwardly from respective upper edges of the tall end and the sides of the frame to a shaker screen which is wider than it is long.

BRIEF DESCRIPTION OF THE DRAWINGS

The foregoing and other objects, features, and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIG. 4 is a partial cross sectional elevational view of the loam screening apparatus of FIG. 1 taken along line 4—4 and showing the shaker screen drive;

FIG. 4A is a side view of the off-balance fly wheel of the shaker screen drive taken along line 4A—4A of FIG. 4;

FIG. 5 is a cross sectional elevational view of the screening apparatus of FIG. 1, taken along line 5—5 and showing loam and coarse material being dumped onto the shaker screen;

DESCRIPTION OF A PREFERRED EMBODIMENT

Figure 1:
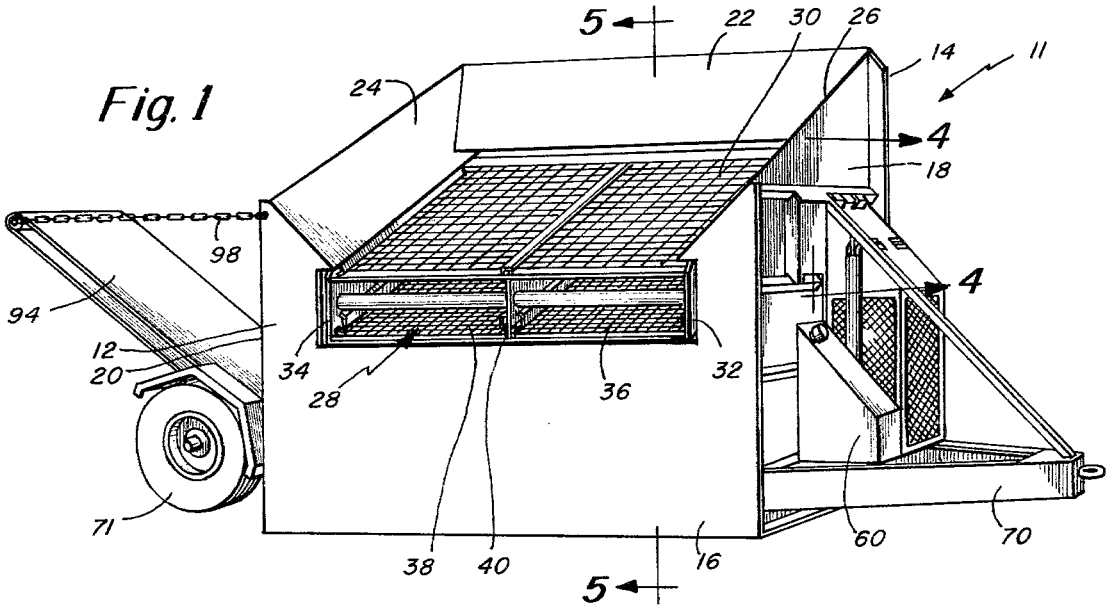
FIG. 1 is a front perspective view of a portable screening apparatus embodying the present invention.

As shown in FIG. 1, the loam separator 11 of the present invention has a box-like structural frame 12 having a generally rectangular horizontal cross section. The frame 12 has a tall rear end 14, a short front end 16 and the sides 18 and 20. The front end 16 and sides 18 and 20 are closed while the tall end 14 is open. The frame thus forms a three sided enclosure the interior of which is shown in FIG. 2.

A funnel is formed at the top of frame 12 by funneling surfaces 22, 24 and 26 which extend downward and inward from the upper edges of the tall end and sides of the frame. A shaker assembly 28 is supported by the frame below the funneling surfaces 22, 24 and 26. This shaker assembly extends to the upper edge of the short end 16. With the funneling surfaces there is no need for a hopper over the shaker screen.

The shaker assembly 28 includes an upper screen 30 stretched between side plates 32 and 34. Two lower screens 36 and 38 are stretched between the side plates and a center plate 40. The upper screen 30 is of a mesh size which separates very coarse material from loam and less coarse material and the lower screens 36 and 38 are of a finer mesh which separates the remaining coarse material from the fine loam. A preferred shaker assembly is disclosed in detail in copending U.S. patent application Ser. No. 17,757, filed Mar. 5, 1979 by James L. Read and William K. Morgan and assigned to the assignee of this invention. For proper operation of the shaker assembly when separating loam, the shaker screens should be pitched at an angle of between 16 and 24 degrees, preferably at about 20 degrees.

Figure 2:
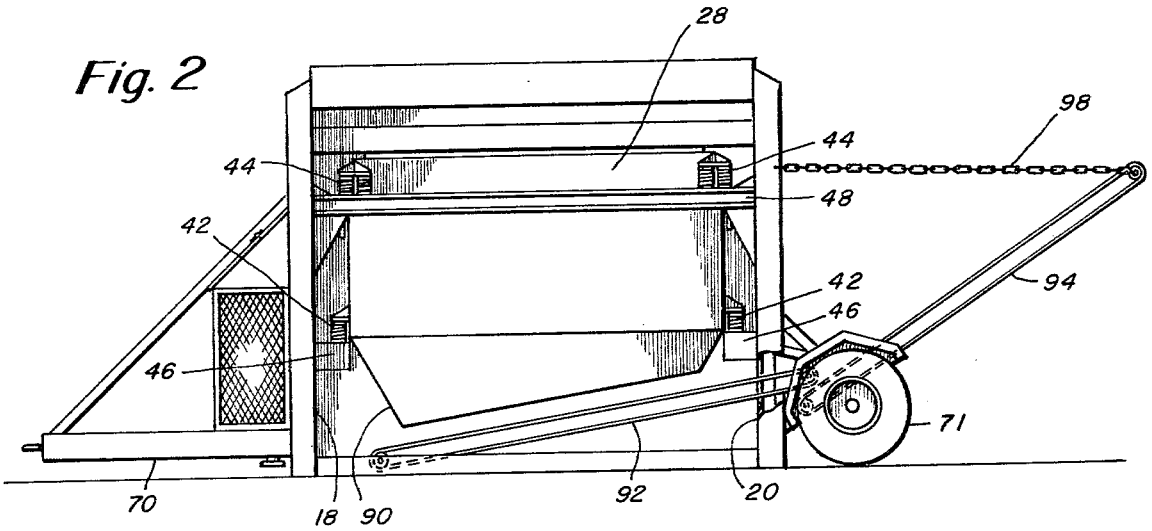
FIG. 2 is a rear view of the screening apparatus of FIG. 1.
Figure 3:
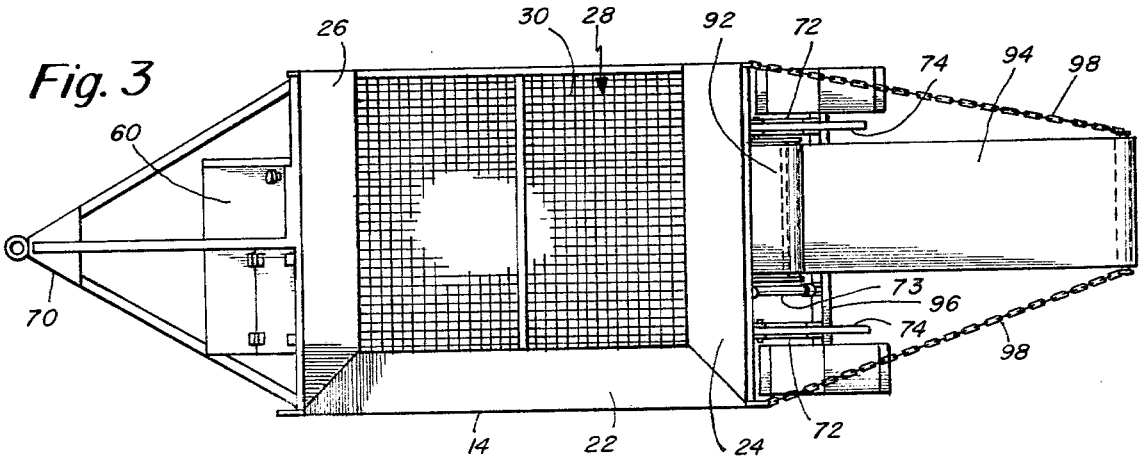
FIG. 3 is a top view of the screening apparatus of FIG. 1.

As shown in FIG. 2, the shaker screen assembly 28 is supported on front compression springs 42 and rear compression springs 44. The springs 42 rest on and are fixed to shelves 46 extending inwardly from respective side walls 18 and 20. Springs 44 rest on and are fixed to an I-beam 48 which extends between the side walls.

The assembly 28 bounces on the springs in a rotary movement through operation of an off-balance shaft mechanism shown in FIG. 4. Each side plate 32, 34 has a bearing 50 therein to support a shaft 52 for rotary movement. The shaft 52 has an off-balance weight 54 welded to one side thereof. Also, an off-balance flywheel 56 is fixed to each end of the shaft 52. An hydraulic motor 58 mounted to the plate 32 drives the shaft 52, and the resulting off-balance rotary movement of the shaft causes the assembly 28 to shake on springs 42 and 44.

The driving force for the hydraulic motor 58 is provided by oil from a tank 60. The oil is pumped through a valve 62 and flexible lines 64 by a pump 66. The pump 66 is mounted to a one cylinder diesel motor 68. The diesel motor 68 and tank 60 are both mounted to the side 18 of the frame.

Because the driving force for the shaker assembly is provided through flexible lines 64 the hydraulic motor 58 can be mounted directly to the shaker assembly and move with the assembly. A direct drive is thus possible from the hydraulic motor 58 to the off-balance shaft 52.

Figure 6:
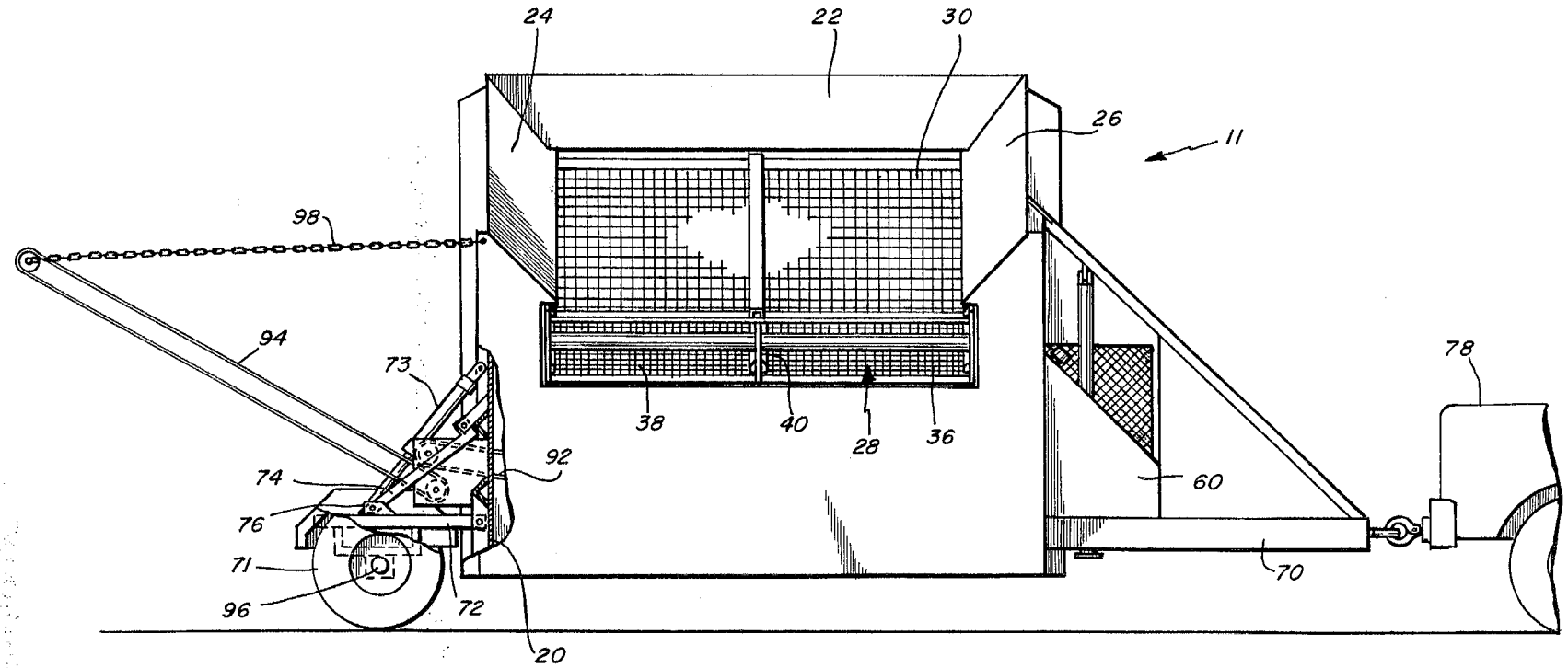
FIG. 6 is a front view of the screening apparatus of FIG. 1 but with the wheels in a transporting position and the apparatus connected as a trailer behind a motor vehicle.

For transport of the loam screening apparatus 12, a trailer hitch 70 is connected to the side 18 and a set of wheels 71 is connected to the opposite side 20. The wheels 71 are mounted to pivotal arms 72 extending from the side 20. When the loam screening apparatus is in use, the arms 72 are pivoted up to the inoperative position of FIG. 2 so that the frame 12 rests flush on the ground. When the apparatus is to be transported, the side 20 is lifted a foot or more from the ground by hydraulic cylinders 73 and braces 74 are secured by pins 76 to the arms 72 (FIG. 6). With the side 20 on the wheels 71 the loam screening apparatus can be transported as a trailer by a vehicle 78.

Use of the loam screening apparatus of the present invention can be best understood with reference to FIGS. 2 and 5. With the wheels 71 pivoted to a raised inoperative position, the frame 12 rests flush on the ground. A load of loam and coarse material 80 is dumped from the shovel 82 of a payloader type excavating vehicle 84 onto the shaker screen assembly 28. The material 80 is dumped near the upper funneling surface 22. The vibrating movement of the shaker screen jars the loam loose from the coarse material, and the loam drops through the screens 30, 36 and 38. Coarser material, unable to drop through the screens, moves down toward the lower end 86 of the shaker screens. The coarse material then drops from the end of the shaker assembly to a pile of coarse material 88. The loam, however, falls within the enclosure defined by the short end wall 16 and the sides 18 and 20. The loam is directed by a hopper 90 onto an outfeed conveyor 92. For separating loam the hopper sides should be angled at least 51° from the horizontal.

The loam or other fine material which drops through the screen assembly 28 and the hopper 90 onto the conveyor 92 is carried by the conveyor 92 through the side 20 of the apparatus. The loam is there dropped onto a stacking conveyor 94 which carries the loam up over the axle 96. The upper end of the conveyor 94 is suspended by chains 98 which extend from the frame 12 of the separator. The stacking conveyor 94 carries the loam to a sufficient height for dropping the material onto a pile. Alternatively, the conveyor 94 may feed to some other modular unit of a large plant such as a washing unit for sand or the like.

Figure 7:
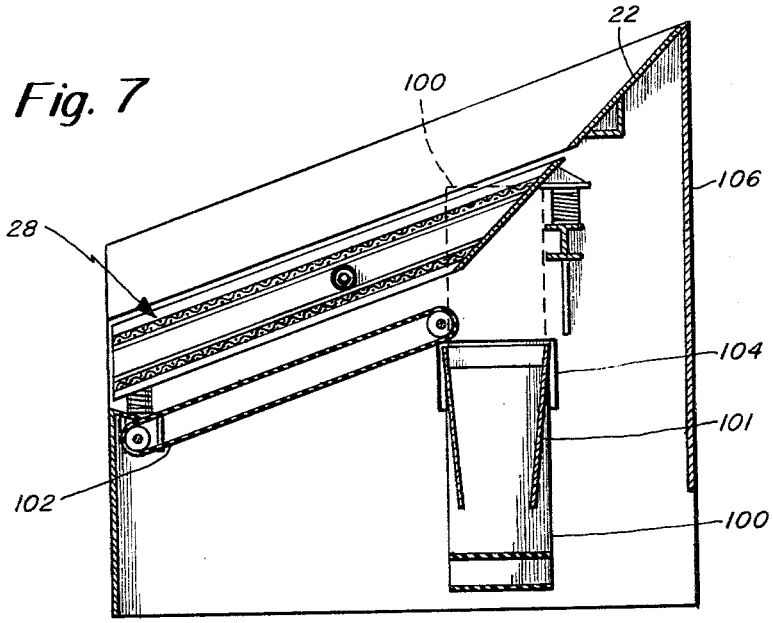
FIG. 7 is a cross-sectional, elevation view of an alternative embodiment of the invention.
Figure 8:
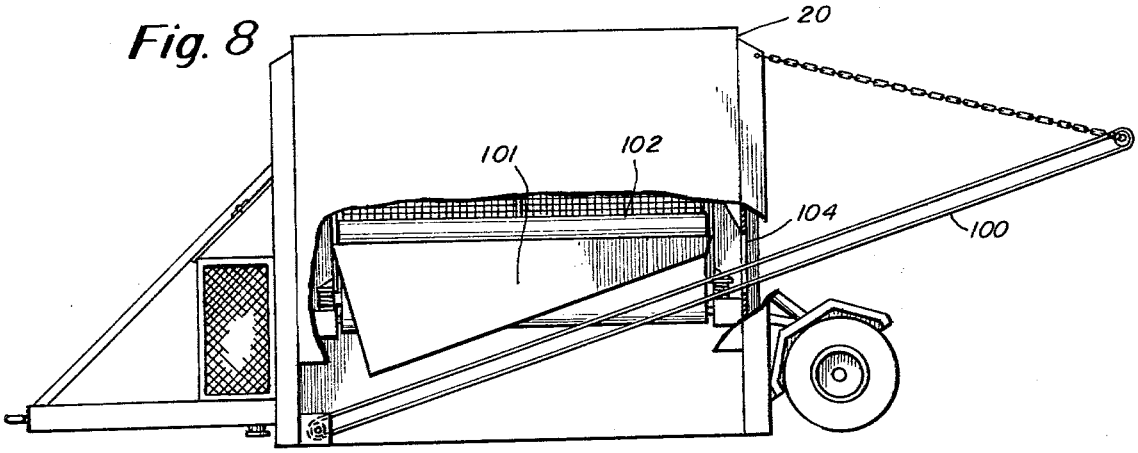
FIG. 8 is a rear view of the embodiment of FIG. 7, partially broken away.

Another embodiment of the invention is shown in FIGS. 7 and 8. In that embodiment, loam or other fine material which falls through the shaker assembly drops onto a wide feed conveyor 102 which carries that loam upward and toward the rear of the assembly. It drops the loam through a hopper 101 onto the conveyor 100 which carries that loam out through an opening 104 in the side 20 as before. In this embodiment, the outfeed conveyor 100 can be placed at a sufficient angle that it may also serve as a stacking conveyor. To prevent coarse material from dropping from the shovel 82 directly onto the conveyor 100 during loading of the apparatus, a wall 106 extends downwardly from the end funneling surface 22 to cover the conveyor 100. To permit access to within the frame 12, the lower portion of the rear end of the frame 12 is left open.

Proper dimensioning of the screening apparatus is important to enable loading of the apparatus by payloader 84 and to permit towing of the apparatus along highways. The tall end 14 must be sufficiently wide and low to accomodate the use of a payloader. Typical payloaders have shovels three-quarter to two yards wide. For use with even small shovels, the width of the tall end should be at least five feet. In the preferred embodiment, the tall end is nine feet six inches wide, and the screen is seven feet three inches wide. The tall end must be sufficiently low for the payloader to reach over the funneling surface 22. To that end, it should be no greater than about ten feet; and in the preferred embodiment the height of the tall end with the wheels collapsed is nine feet four inches.

To permit ready access to the tall end for loading of the screening apparatus and to provide an area suitable for piling of the rejected coarse material, both the tall and short ends should be free of miscellaneous structures such as the collapsed wheels. To that end, the screening plant is adapted for sideways towing with wheels and hitch on opposite sides of the frame 12. In many states, there is a legal limit of about eight feet for a towed vehicle. Thus, the length of the sides 18 and 20 are less than eight feet. In the preferred embodiment it is seven feet ten inches with a screen six feet six inches long.

It can be seen from the above that the screen assembly 28 is wider than it is long. This violates the conventional rule of thumb, but the screening capability of the assembly has been found very adequate for rough screening.

The outfeed conveyor 92 and 100 may be permanently fixed to the main frame 12 or they may be moved into position once the frame has been set in place for operation. Similarly, the stacking conveyor 94 is generally removed for transport of the plant.

While the invention has been particularly shown and described with reference to preferred embodiments thereof, it will be understood by those skilled in the art that various changes in form and detail may be made therein without departing from the spirit and scope of the invention as defined by the appended claims.

I claim:

1. A portable screening apparatus for separating coarse material from finer material comprising:

a frame of generally rectangular cross section and having a tall end and a short end joined by sides, the frame at the tall end being sufficiently wide and low to accomodate the shovel of a payloader;

a material separating shaker screen sloping downward from near the upper edge of the tall end to near the upper edge of the short end;

a set of wheels mounted to one of said sides and movable relative to the frame from an operative position for transporting said apparatus to an inoperative position for resting the frame flush on the ground;

a trailer hitch mounted to the other of said sides;

an outfeed conveyor extending from within the frame through one of said sides to carry finer material out of the frame; and means for directing finer material which falls through the shaker screen to the conveyor.

2. A portable screening apparatus as claimed in claim 1 wherein the frame at the tall end is at least five feet wide and is no more than ten feet high.

3. A portable screening apparatus as claimed in claim 1 or 2 wherein the length of the sides is less than eight feet.

4. A portable screening apparatus as claimed in claim 1 or 2 wherein said sides are closed.

5. A portable screening apparatus as claimed in claim 1 or 2 wherein a power source for said shaker screen is mounted to a side of said frame.

6. A portable screening apparatus as claimed in claim 1 or 2 wherein the downwardly sloping length of said shaker screen is less than the width of said screen.

7. A portable screening apparatus as claimed in claim 1 or 2 wherein the means for directing finer material is a hopper positioned below the shaker screen.

8. A portable screening plant as claimed in claim 1 or 2 wherein the outfeed conveyor extends through the side to which the wheels are mounted.

9. A portable screening plant as claimed in claim 1 or 2 further comprising three funneling surfaces extending inward and downward from respective upper edges of the tall end and sides of the frame to the shaker screen.

* * * * *